US005876894A

United States Patent [19]

Leclair

[11] Patent Number: 5,876,894

[45] Date of Patent: Mar. 2, 1999

[54] TONER CONTAINING A SILICONE WAX RELEASE AGENT

[75] Inventor: Albert W. Leclair, Hudson, N.H.

[73] Assignee: Nashua Corporation, Nashua, N.H.

[21] Appl. No.: 740,377

[22] Filed: Oct. 29, 1996

Related U.S. Application Data

[60] Provisional application No. 60/006,133, Nov. 2, 1995.

[51] Int. Cl.[6] ..... G03G 9/97

[52] U.S. Cl. ..... 430/110; 430/137

[58] Field of Search ..... 430/110, 137

[56] References Cited

U.S. PATENT DOCUMENTS

| | | | |
|---|---|---|---|
| 4,134,760 | 1/1979 | Gibson et al. | 430/110 |
| 4,388,396 | 6/1983 | Nishibayashi et al. | 430/126 |
| 4,614,700 | 9/1986 | Yamamoto et al. | 430/122 |
| 4,623,602 | 11/1986 | Bakker et al. | 430/106 |
| 4,745,418 | 5/1988 | Brennan et al. | 346/74.5 |
| 4,758,493 | 7/1988 | Young et al. | 430/122 |
| 4,760,007 | 7/1988 | Takasu et al. | 430/122 |
| 4,795,689 | 1/1989 | Matsubara et al. | 430/99 |
| 4,810,610 | 3/1989 | Grushkin et al. | 430/106.6 |
| 4,814,253 | 3/1989 | Gruber et al. | 430/106.6 |
| 4,820,604 | 4/1989 | Manca et al. | 430/110 |
| 4,849,316 | 7/1989 | Kawaski et al. | 430/110 |
| 4,868,084 | 9/1989 | Uchide et al. | 430/110 |
| 4,873,185 | 10/1989 | Uchida et al. | 430/110 |
| 4,879,198 | 11/1989 | Tavernier et al. | 430/106.6 |
| 4,895,785 | 1/1990 | Torimoto et al. | 430/111 |
| 4,935,324 | 6/1990 | Grushkin et al. | 430/98 |
| 5,225,303 | 7/1993 | Tomita et al. | 430/106.6 |
| 5,310,616 | 5/1994 | Akamatsu | 430/110 |
| 5,512,406 | 4/1996 | Takeda et al. | 430/110 |
| 5,620,825 | 4/1997 | Tavernier et al. | 430/110 |
| 5,712,074 | 1/1998 | Sato et al. | 430/110 |

FOREIGN PATENT DOCUMENTS

| | | | |
|---|---|---|---|
| 0 560 377 A1 | 9/1993 | European Pat. Off. . | |
| 41 30 192 A1 | 9/1991 | Germany . | |
| 56-123551 | 9/1981 | Japan . | |
| 56-150757 | 11/1981 | Japan . | |
| 56-185152 | 12/1981 | Japan . | |
| 59-197048 | 11/1984 | Japan | 430/110 |
| 3-155561 | 7/1991 | Japan | 430/110 |
| 3-291671 | 12/1991 | Japan | 430/110 |

*Primary Examiner*—Roland Martin
*Attorney, Agent, or Firm*—Testa, Hurwitz & Thibeault, LLP

[57] ABSTRACT

An improved toner for use in electrostatic copying processes is described. The toner, which exhibits high fixing ability at low temperatures, includes a binder resin, a colorant, and a silicone wax release agent. A method for reducing or preventing offset in a toner and increasing the lubricity of the toner is also described. The method comprises combining the silicone wax release agent and the colorant with the binder resin to form the toner.

17 Claims, No Drawings

TONER CONTAINING A SILICONE WAX RELEASE AGENT

CROSS REFERENCE TO RELATED APPLICATIONS

This application claims the benefit of prior filed co-pending provisional application Ser. No. 60/006,133, filed Nov. 2, 1995, the specification of which is incorporated herein by reference.

FIELD OF THE INVENTION

The present invention relates to toners for use in electrostatic copying processes, and in particular to toners having a silicone wax release agent.

BACKGROUND OF THE INVENTION

The present invention relates to an improved toner for use in an electrostatic copying process. Such processes are now commonly used by laser printers and photocopy machines.

Electrostatic processes use finely divided dry toners or developers. Dry toners typically have a coloring agent, such as carbon black, dispersed throughout a natural or synthetic binder resin. Developers can be monocomponent substances in which the toner formula contains magnetic particles, monocomponent substances in which the toner is non-magnetic, or two component systems which have dry toners and separate magnetic carrier particles.

Toner particles can be triboelectrically charged to a proper polarity. This insures that the toner particles will be preferentially attracted to desired image areas on a latent image field during the copying or printing process. Often toners include charge control agents which moderate the magnitude and polarity of the charge. After the image is developed by the toner, the image on the latent image field is "fixed" onto a permanent substrate, such as paper. "Fixing" can be effected by applying heat or solvent to the toner image after the image has been transferred to a sheet of paper, which melts the resin particles in the toner, causing them to fuse to the paper or other substrate.

"Melt fixing," that is, fixing by applying heat to the toner image, is accomplished by applying heat to the sheet of paper by means of heated rollers. The rollers, known as fusing rollers, apply both heat and pressure to the sheet. Fusing rollers are widely employed because high-speed fixation of latent images can be achieved with this method.

In order to reduce fixing time, it is desirable for a binding resin to exhibit high fixing ability even at low temperatures. To achieve this end a binder resin having a low softening temperature typically is used. This practice, however, has the drawback that toner particles may partially stick to the fusing rollers, damaging them. Also, residual toner on the fusing rollers is transferred to subsequent sheets of paper. This stains the background of those sheets, resulting in poor image quality. This is the well-known and undesirable "offset" phenomena.

To retain the high fixing ability of these resins at low fixing temperatures while reducing the offset of toner, lubricants have been added to various systems in order to prohibit the toner particles from sticking to the fusing rollers. An initial effort was to provide fusing rollers covered with a thin film of lubricant, such as a fluorocarbon resin or silicone oil. This method, however, suffers from several drawbacks: for example, the heat from the fuser rollers can cause odors to emanate from the liquid or the roller coating, damage to the fuser rollers can result in a messy oil spill, and the use of silicone liquid requires a complex apparatus for metering of liquid to the rollers.

Another method which has been used to prevent or minimize this problem is adding a wax, such as a paraffin or polyolefin wax, to the toner itself. In theory, the wax component should be sufficiently incompatible with the toner resin so that it does not mix with the toner resin. This ensures that when the paper imprinted with the toner image passes through the hot fuser rollers, the wax rises to the surface of the toner, forming a waxy coating which prevents the toner from sticking to the rollers. However, paraffin or polyolefin waxes may adhere to the roller or paper surface, which reduces the quality of the image. In some toner compositions, the polyolefin wax is sufficiently compatible with the toner that it does not rise to the surface of the toner and, so, does not prevent offset from occurring. Various alcohols, varnishes and silicone oils have also been tried, but none have imparted a sufficiently high resistance to the offset phenomena. In addition, these lubricants showed a tendency to adhere to the carrier particles, reducing developer life and image quality.

The present invention achieves the aforementioned desirable characteristics while avoiding the undesirable characteristics of prior art toners.

SUMMARY OF THE INVENTION

The present invention provides an improved toner for use in electrostatic copying processes comprising a binder resin, a colorant, and a silicone wax release agent. The toner of the present invention exhibits high fixing ability at low temperatures while greatly reducing residue build-up on the fusing roll. In a preferred embodiment, the toner comprises a binder resin, colorant, a charge control agent and alkyl-alkyd siloxane compound as the release agent.

A method for reducing or preventing offset in a toner and increasing the lubricity of the toner by incorporating a silicone wax release agent into the toner is another aspect of the present invention. The method comprises combining the silicone wax release agent and the colorant with the binder resin to form the toner.

DETAILED DESCRIPTION OF THE INVENTION

The improved toner of the present invention comprises, at a minimum, a binder resin, a colorant, and a silicone wax release agent.

The present release agent can be any solid silicone material that is easily compounded in the toner mixture and that imparts lubricity to the toner and prevents it from sticking to the hot fuser rollers during image fixing. Silicone waxes are effective for this purpose. Ethyl silicate, silanes, and silanediols can be used, although siloxane compounds are preferred.

Any siloxane monomer or polymer may be used. For example, alkyd siloxanes, alkyl siloxanes, alkyl-alkyd siloxanes, and alkyd-alkyl siloxanes are suitable materials. Preferred siloxane compounds are alkyd-alkyl siloxanes.

The siloxane material which is currently most preferred is an alkyd derivatized methyl siloxane. A suitable alkyd methyl siloxane is poly(octadecylmethylsiloxane), which is sold by Dow Corning, located in Midland, Mich. The amount of silicone wax included in the toner may be from about 0.5% to 5.0% by weight, although most preferred is about 2.0% by weight.

The binder resin can be any natural or synthetic polymer resin. If synthetic polymer resins are used, a styrene polymer resin is preferred. The styrene polymer resin may be either a homopolymer of styrene or copolymer of styrene with other monomers. Monomers which can be copolymerized with styrene to form a copolymer include butadiene, p-chlorostyrene; vinyl napthalene; ethylenically unsaturated monolefins such as, for example, ethylene, propylene, butylene and isobutylene; vinyl esters such as, for example, vinyl chloride, vinyl bromide, vinyl fluoride, vinyl acetate, vinyl propionate, vinyl benzoate and vinyl butyrate; esters of α-methylene; aliphatic monocarboxylic acids such as, for example, methyl acrylate, ethyl acrylate, n-butyl acrylate, 2-chloroethyl acrylate, phenyl acrylate, methyl α-chloroacrylate, methyl methacrylate, ethyl methacrylate, butyl methacrylate, acrylonitrile, methacrylonitrile, and acrylamide; vinyl esters such as, for example, vinyl methyl ether, vinyl isobutyl ether and vinyl ethyl ether; vinyl ketones such as, for example, vinyl methyl ketone, vinyl hexyl ketone and methyl isopropenyl ketone; and N-vinyl compounds such as, for example, N-vinyl pyrrole, N-vinyl carbazole, N-vinyl indole and N-vinyl pyrrolidene. One or more of these monomers may be copolymerized with a styrene monomer. Mixtures of two or more styrene-type resins also may be used. Suitable styrene resins have an average molecular weight of at least about 3,000 or more and the styrene content of the resin is preferably at least about 25% by weight based on the total weight of the styrene-type resin.

Thermoplastic binder resins prepared by mixing a styrene-type resin with other resins may also be used as the resin component of the present toner. Other resins capable of being mixed with the styrene-type resin include homopolymers or copolymers of the following monomers: vinyl naphthalene; vinyl esters such as, for example, vinyl chloride, vinyl bromide, vinyl fluoride, vinyl acetate, vinyl propionate, vinyl benzoate and vinyl butyrate; esters of α-methylene aliphatic monocarboxylic acid such as, for example, methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate, acrylonitrile, methacrylonitrile, and acrylamide; vinyl ethers such as, for example, vinyl methyl ether, vinyl isobutyl ether and vinyl ethyl ether; vinyl ketones, such as, for example, vinyl methyl ketone, vinyl hexyl ketone and methyl isopropenyl ketone; and N-vinyl compounds, such as, for example, as N-vinyl pyrrole, V-vinyl carbazole, N-vinyl indole and N-vinyl pyrrolidone. Non-vinyl type thermoplastic resins also can be used such as, for example, resin-modified phenol formalin resins, oil-modified epoxy resins, polyurethane resins, cellulose resins and polyether resins. In the case where the above-mentioned resin is used in admixture with the styrene-type resin, both resins are preferably mixed with each other in such a manner that the styrene component comprises at least about 25% by weight based on the total weight of the resulting resin, preferably greater than about 60% by weight.

Currently preferred binder resins comprise a mixture of a styrene-butadiene resin and a styrene-acrylic copolymer in which styrene is copolymerized with one or more acrylic monomers. Acrylic monomers which are preferred co-monomers include acrylic acid, methacrylic acid, methylmethacrylate, ethyl acrylate, ethylmethacrylate, butylacrylate and butylmethacrylate.

The resin preferably comprises from about 30% to about 90% by weight of the toner. The resin most preferably comprises about 85% by weight of the toner. In a preferred embodiment, two different styrene copolymer resins are blended. In the most currently preferred embodiment of the present toner, a mixture of two styrene copolymers is used, a styrene-butadiene copolymer and a styrene-acrylic copolymer. The styrene- butadiene copolymer resin preferably comprises a high-molecular-weight polymer, e.g. having a molecular weight of about 100,000 with a polydispersity of about 10. The styrene-acrylic copolymer resin preferably comprises polymers having a molecular weight of about 35,000 and a polydispersity of about 3.5. The preferred ratio of styrene-butadiene resin to styrene-acrylic resin is from about 70:30 to 60:40, most preferably about 74:36.

Any suitable pigments and/or dyes can be used which are compatible with the formulation can be used as the colorant. For example, pigments such as carbon black, lampblack, nigrosine dyes, aniline blue, calco oil blue, chrome yellow, ultramarine blue, DuPont oil red, quinoline yellow, methylene blue chloride, phthalocyanine blue, malachite green oxalate, rose bengal, benzidine yellow, and mixtures of the above can be used. The amount included in the toner should be sufficient to impart the desired color and color intensity to the image formed from the toner. The amount of pigment added is preferably from about 5% to about 50% by weight. The most preferred embodiment comprises about 10% carbon black by weight.

A charge control agent can be added to the present toner composition. Depending on the electrostatic process used, the charge control agent may be selected to impart either a negative or positive charge to the toner resin. Charge-control agents are well-known in the art. Charge control agents which impart a negative charge include materials such as orthohalophenylcarboxylic acids, metal complexes of aromatic carboxylic acids and dicarboxylic acids, sulfonylamine derivatives of copper phthalocyanine dyes, metal complexes of azo dyestuffs and pyridoxine aliphatic acid esters. Charge control agents which are positively chargeable include quaternary ammonium compounds, alkyl pyridinium compounds and nigrosine dyes. Charge control agents which are particularly preferred for use in the present formulation are quaternary compounds. In a currently preferred embodiment, the charge control agent used comprises a quaternary ammonium salt, which is available from Witco Corporation., Greenwich, Conn., under the tradename Arosurf™ TA101. The amount of charge control agent is preferably from about 0.5% to about 5.0% by weight of the toner formulation. In a most preferred embodiment, the charge control agent is about 1.5% of the toner composition by weight.

The toner of the present invention can be made by any art-recognized process. For example, the ingredients may be thoroughly mixed by blending, mixing and milling the components e.g, by ball-milling or extrusion, and thereafter pulverizing the components, e.g., by jet-milling to form particles having the desired size. Another well-known technique for forming toner particles is by spray-drying a ball-milled composition containing a colorant, resin and a solvent. Toners of the present invention preferably have an average particle size of from about 5 μ to about 15 μ, and more preferably have an average particle size of between about 10 μ and 12 μ.

A currently preferred toner formulation made according to the present invention has the following formula:

| | | |
|---|---|---|
| styrene-butadiene polymer | 64.0% | by weight |
| styrene-acrylic polymer | 22.5% | by weight |

-continued

| | | |
|---|---|---|
| carbon black | 10.0% | by weight |
| Arosurf ™ TA101 | 1.5% | by weight |
| poly(octadecylmethylsiloxane) | 2.0% | by weight |

The currently preferred toner is made by an extrusion process, which is well-known in the art. In general, a dry, coarse blend of the desired toner ingredients is fed into an extruder. The material is heated as it passes through the extruder, which kneads and blends the material into a homogeneous, molten mass. After the mass is extruded, it cools and solidifies. The cooled, solid mass is then pulverized into a fine powder by any appropriate process, e.g. grinding or jet milling.

The present toner compositions provide excellent image density, charge stability and anti-offset properties, even after continuous and/or high speed copying.

The toner of this invention may, if necessary or desirable, contain other additives. Such additives include, for example, magnetic materials, fixability improving agents, fluidity improving agents, abrasives, and the like. These additives may be contained either in the mixedly dispersed state in the polymer or in the state of adhering to the surface of the toner particles.

Examples of magnetic materials which can be used include ferrite, magnetite, ferromagnetic metals such as iron, cobalt, nickel, etc.; alloys of these metals; compounds containing these elements; those alloys which do not contain any ferromagnetic elements but, when subjected to a proper heat treatment, show ferromagneticity; manganese-and-copper-containing alloys such as, for example, manganese-copper-aluminum, manganese-copper-tin, and the like; and chromium dioxide and others. Any of these magnetic materials is preferably in fine powdery form having an average grains size of from about 0.1 to about 1 $\mu$m and to be contained in the uniformly dispersed state in the toner. Where the toner is to be a magnetic toner, the proportion of the magnetic material to the toner is preferably from about 20–70 parts by weight to about 100 parts by weight of the toner, and particularly preferably about 25 to 50 parts by weight.

As the fluidity improving agent or abrasive, for example, inorganic fine particulate materials or other equivalents may be used, and their primary particle size is preferably from about 5 m$\mu$ to about 2 m$\mu$, and more preferably from about 5 m$\mu$ to about 500 m$\mu$. And their specific surface area according to the BET method is desirable to be from about 20 to about 500 $m^2/g$. The proportion of such fine particulate material to the toner is preferably from about 0.01 to about 5% by weight, and particularly preferably from about 0.1 to about 2.0% weight. These fine particles are desirable to be contained in the toner in the state of adhering to or eating into the toner grains' surface. Useful examples of the fine particulate material include silica, alumina, titanium oxide, barium titanate, magnesium titanate, calcium titanate, strontium titanate, zinc oxide, silica sand, clay, mica, wollastonite, diatom earth, chromium oxide, cerium oxide, red oxide, antimony trioxide, magnesium oxide, zirconium oxide, barium sulfate, barium carbonate, calcium carbonate, silicon carbide, silicon nitride, and the like. Of these materials, fine particulate silica is particularly useful.

The silica may be in the form of anhydrous silica dioxide, aluminum silicate, sodium silicate, potassium silicate, magnesium silicate, zinc silicate, or the like, and is particularly preferable when containing more than about 85% by weight $SiO_2$.

There are a variety of commercially available silica products, but among them those having a hydrophobic group on the surface thereof are suitable usable. Such useful products include, for example, Aerosil™ R-972, Aerosil™ R-974, Aerosil™ R-805, Aerosil™R-812, (produced by Nippon Aerosil), and Talanox™ 500 (produced by Talco), and the like. Besides, those silica fine particles surface-treated by a silane-coupling agent, titanium-coupling agent, silicone oil, or a silicone oil having amine on its side chain, or the like, may be effectively used. In a currently preferred embodiment of the present invention, silica particles available under the tradename Aerosil™ R-972 are used. The preferred concentration of silica in the formulation is in the range of from about 0.05% to about 1.0% by weight, and, in the currently preferred formulation, about 0.15% by weight.

In a two-component development system, carrier particles are used with the toner. Suitable coated and uncoated carrier materials for development which can be used with the toners of the present invention are well-known in the art. The carrier particles comprise any suitable solid materials, provided that the carrier particles acquire a charge having an opposite polarity to that of the toner particles when brought in close contact with the toner particles, so that the toner particles adhere to and surround the carrier particles. When a positive reproduction of the electrostatic images is desired, the carrier particle is selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus the materials for the carrier particles are selected in accordance with their triboelectric properties in respect to the electroscopic toner so that when mixed or brought into mutual contact, one component of the developer is charged positively if the other component is below the first component in the triboelectric series and negatively if the other component is above the first component in a triboelectric series. By proper selection of carrier materials in accordance with their triboelectric effects, the polarities of their charge, when mixed, are such that the electroscopic toner particles adhere to and are coated on the surfaces of carrier particles and also adhere to that portion of the electrostatic image-bearing surface having a greater attraction for the toner than the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, silicon dioxide, nickel, steel, iron, ferrites, and the like. The carriers may be employed with or without a coating. A coated carrier particle diameter between about 50 microns to about 1,000 microns is preferred because the carrier particles then possess sufficient density and inertia to avoid adherence to the electrostatic images during the cascade development process. Adherence of carrier beads to electrostatographic drums is undesirable because of the formation of deep scratches on the surface during the imaging transfer and drum cleaning steps. Also print deletion occurs when carrier beads adhere to electrostatographic imaging surfaces. Satisfactory results are obtained when about 1 part toner is used with about 10 to about 200 parts by weight of carrier.

The toner compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a nonphotoconductive matrix, organic or inorganic photoconductors embedded in a photoconductive matrix, or the like.

Although only preferred embodiments are specifically illustrated and described herein, it will be appreciated that many other modifications and variations of the present invention are possible in light of the above teachings and within the preview of the appended claims without departing from the spirit and intended scope of the invention. Other objects, features and advantages of the invention shall become apparent when the following examples and claims are considered.

EXAMPLES

Example 1

| | % by weight |
|---|---|
| styrene-butadiene polymer [Almacryl ® B-1708, Zeneca Resins] | 64 |
| styrene-acrylic polymer [S-111, Nippon Zeon] | 22.5 |
| carbon black [Regal 330, Cabot Corp., Special Blacks Division] | 10.0 |
| quaternary ammonium salt charge control agent [Arosurf ™ TA101; Witco Chemicals, Inc.] | 1.5 |
| poly(octodecylmethyl siloxane) [DC 2-5671; Dow Corning Corp.] | 2.0 |
| | 100.00 |

The mixture was fed into an extruder which heated and kneaded the material to form a homogeneous molten mass. The molten blend was extruded and cooled to form a solid mass. The cooled solid mass was pulverized into a fine powder by a jet milling process. The resulting toner was a fine powder having an average particle size of 10–12 $\mu$. The toner particles are classified to remove particles below about 5 microns and above about 20 microns. The toner then is dry blended with the silica.

Comparative Example 1

A comparative toner was prepared as described in Example 1 except that the siloxane was omitted.

Both toners were used in a Xerox 5100 copier. The toner of Example 1 provided copies with excellent image density, and the toner exhibited excellent charge stability and substantially no contamination of the fuser rollers occurred. The toner of Comparative Example 1 provided copies with inferior image quality, and the toned image stuck to the fuser rolls, leaving deposits which caused contamination of subsequent copies.

I claim:

1. A toner composition comprising a mixture of:

a binder resin;

a colorant; and a release agent comprising a poly (octadecylmethylsiloxane) homopolymer.

2. The toner composition of claim 1 wherein the binder resin is a styrene copolymer.

3. The toner composition of claim 2 wherein the styrene copolymer is selected from the group consisting of styrene-acrylic copolymers and styrene-butadiene copolymers.

4. The toner composition of claim 2 wherein the binder resin comprises a combination of a styrene-acrylic copolymer and a styrene-butadiene copolymer.

5. The toner composition of claim 1 wherein the colorant comprises carbon black.

6. The toner composition of claim 1 further comprising a charge control agent.

7. The toner composition of claim 6 wherein the charge control agent is a quaternary ammonium salt.

8. The toner composition of claim 1 further comprising a fixability improving agent.

9. The toner composition of claim 1 further comprising a fluidity improving agent.

10. A method for making a toner composition comprising the steps of (a) providing a binder resin;

(b) providing a colorant;

(c) providing a release agent comprising a poly (octadecylmethylsiloxane)homopolymer;

(d) mixing the binder resin, the colorant, and the release agent together to form a toner composition; and (e) pulverizing the mixed toner composition to form toner particles having a desired change.

11. The method of claim 10 wherein step (d) further comprises:

(d-a) heating the binder resin, the colorant, and the release agent;

(d-b) kneading the heated resin, colorant, and release agent to form a mixed, molten toner composition;

(d-c) cooling the mixed molten toner composition until it solidifies; and (d-d) pulverizing the cooled toner composition to form toner particles having the appropriate size.

12. The method of claim 10 where step (e) comprises jet-milling the mixed toner composition to form toner particles having the desired size.

13. The method of claim 10 further comprising the step of providing a charge control agent to be mixed into the toner.

14. The method of claim 10 further comprising the step of providing a fixability improving agent to be mixed into the toner.

15. The method of claim 10 further comprising the step of providing a fluidity improving agent to be mixed into the toner.

16. A two-component developer comprising:

a carrier particle; and the toner particle of claim 1.

17. A toner composition comprising a mixture of:

a polymer binder resin comprising a styrene-butadiene polymer and a styrene-acrylic polymer;

a colorant comprising carbon-black;

a charge control agent comprising a quaternary ammonium salt; and a poly (octodecylmethylsiloxane)homopolymer release agent.

* * * * *